United States Patent [19]

Fisher

[11] 4,123,154

[45] Oct. 31, 1978

[54] COMBINED CORONA GENERATOR AND IMAGING SURFACE CLEANER

[75] Inventor: Donald J. Fisher, Pittsford, N.Y.

[73] Assignee: Xerox Corporation, Stamford, Conn.

[21] Appl. No.: 773,999

[22] Filed: Mar. 3, 1977

[51] Int. Cl.[2] ..... G03G 21/00

[52] U.S. Cl. ..... 355/15; 15/1.5 R; 15/256.52; 361/225

[58] Field of Search ..... 355/15; 15/1.5 R, 256.52, 15/256.51, 256.5; 250/325, 326; 361/225

[56] References Cited

U.S. PATENT DOCUMENTS

| | | | |
|---|---|---|---|
| 3,722,018 | 3/1973 | Fisher | 15/1.5 |
| 3,780,391 | 12/1973 | Leenhouts | 355/15 X |
| 3,879,785 | 4/1975 | Roth et al. | 355/15 X |
| 3,965,524 | 6/1976 | Kurita et al. | 355/15 X |
| 4,057,723 | 11/1977 | Sarid et al. | 361/225 X |

*Primary Examiner*—Richard L. Moses

[57] ABSTRACT

A cleaning apparatus and an electrostatographic reproducing machine wherein a cleaning element is arranged to remove residual material from an imaging surface. The cleaning element is subjected to corona emissions from a one or more corona generators and is arranged to engage both the imaging surface and the corona devices to clean them both. In an alternative embodiment the corona emission device is utilized as a flicking element to help remove the residual material from the cleaning element.

5 Claims, 2 Drawing Figures

COMBINED CORONA GENERATOR AND IMAGING SURFACE CLEANER

BACKGROUND OF THE INVENTION

This invention relates to a cleaning apparatus for an electrostatic reproducing machine, in particular it deals with cleaning apparatuses wherein a corona is applied to the cleaning element to improve its operation.

PRIOR ART STATEMENT

One of the difficulties associated with the use of frictional elements in electrostatographic reproducing machines is the control of the charge on the cleaning element relative to the electrostatic toner particles being cleaned. For example, the relative frictional movement between the cleaning element and a photoconductive surface triboelectrically charges the cleaning element opposite to the toner particles. It is difficult to remove the toner particles from the cleaning element if they are strongly attached to it by electrostatic forces. It is known that a corona treatment that charges the toner particles to the same polarity as the cleaning element make it easier to remove the toner particles from the cleaner. Removal of toner particles from an imaging surface can be enhanced if the cleaning element is charged to the opposite polarity of the particles.

Toner remaining on the cleaning element can result in filming of the imaging surface and, therefore, it is important that the toner be effeciently removed from the cleaning element to avoid such filming.

The cleaning elements conventionally used to frictionally clean an imaging surface such as a photoreceptor surface in an electrostatographic reproducing machine comprise brushes, rollers, webs, etc..

Examples of patents showing the use of corona or other alternative means to electrically charge or bias a cleaning element comprise U.S. Pat. Nos. as follows: 2,752,271 to Walkup, et al., 3,722,018 to Fisher, and 3,780,391 to Leenhauts. The Leenhauts patent shows selectively biasing a conductive brush while the Fisher patent shows selectively charging a brush by means of applied coronas.

Fisher recognizes the difficulties associated with locating a corona generator within the cleaning housing. The contamination of toner particles on the coronode wire and the shields can reduce the corona current and produce current non-uniformities. Fisher suggests the use of a self-cleaning corona device as disclosed in U.S. Pat. No. 3,324,291 to Hudson to reduce such problems. The present invention relates to yet another alternative solution to this problem as will be discussed in detail hereafter.

Coronas or biasing have also been employed with the various other types of frictional cleaning elements such as those disclosed in U.S. Pat. No. 3,807,853 to Hudson showing the application of a corona to a foam roll cleaner; and in U.S. Pat. No. 3,523,319 to Stoever showing the selective application of coronas to a web cleaning type element.

In U.S. application Ser. No. 748,805, filed Dec. 8, 1976, to Davis, et al. the continuation of which is allowed Ser. No. 748,805, for a corona charging device there is disclosed a novel corona device for use in electrostatographic reproducing machines which comprises a corona discharge wire coated with a relatively thick dielectric coating. The thickness of the coating being sufficient to prevent the flow of conduction current from the wire. Generation of charge is accomplished by means of a voltage at the dielectric surface established by capacitive coupling through the dielectric material. The magnitude of the flow of charge to the surface to be charged or neutralized or discharged is regulated by the application of a D.C. bias potential to a conductive shield adjacent or contiguous to the electrode.

This corona device solves many of the aforenoted problems associated with prior corona generating devices. In particular it is less affected by chemical growth deposited on the coronode wire as well as being less affected by dirt and toner accumulation on the shield or support blocks.

Yet a further improvement is provided by a device of the type described in U.S. Pat. No. 4,057,723 to Sarid, et al., filed Jan. 23, 1976, now U.S. Pat. No. 4,057,723. The corona discharge device of that application includes a corona discharge electrode of the type described in Davis, et al.'s application. The electrode is located in contact along substantially its entire length with a support surface which may be either insulating or conductive. If the support member is conductive, it may also be biased to perform a control function. If the support surface is dielectric, a conductive member must be located in very close proximity to the electrode. This type of device is advantageous because of its compactness, its structural stability, as well as its ability to generate a given level of charging current at operating voltages less than those needed in a conventional corona device, including the device of Davis, et al.

SUMMARY OF THE INVENTION

In accordance with the present invention cleaning apparatuses are provided wherein the cleaning element which is used to remove toner particles from an imaging surface such as a photoconductive surface is subjected to corona emissions in order to selectively charge or discharge it to improve the efficiency of the cleaning apparatus. An electrostatographic reproducing apparatus incorporating the cleaning system of this invention also forms part of the invention.

One or more corona emission devices are provided internally of the cleaning housing for providing selective charging or neutralization of the cleaning element and any toner particles thereon. The cleaning element is arranged to engage the imaging surface and the corona devices so that it is operative to clean both the imaging surface and the corona devices.

In accordance with another highly unique aspect of this invention a corona emission device is utilized as a flicking element in a brush or roller type cleaner. The use of such a device as a flicker bar provides improvement by neutralizing the toner as soon as it is removed from the cleaning element.

While a brush cleaning element is preferred in accordance with this invention, any frictional type cleaning element such as brushes, rollers, or webs can be used.

In accordance with this invention the unique and newly developed corona emission devices as described in the aforenoted applications of Davis, et al. and Sarid, et al., respectively, are preferably used for selectively charging or neutralizing the cleaning element or as a flicker bar. The use of those new type corona emission devices reduces the effects of contamination of the electrode coronode wire.

Accordingly, it is an object of the present invention to provide an improved cleaning apparatus for use in an electrostatographic reproducing machine.

It is a further object of this invention to provide an apparatus as above wherein the cleaning element is selectively charged and/or neutralized in order to enhance cleaning efficiency.

It is a further object of this invention to provide an apparatus as above wherein the cleaning element is arranged for movement in engagement with the imaging surface and in engagement with a corona emission device in order to clean both elements.

It is a still further object of this invention to provide an electrostatographic reproducing apparatus incorporating the improved cleaning apparatus described above.

These and other object will become more apparent from the following description and drawings.

DETAILED DESCRIPTION OF THE PREFERRED EMBODIMENTS

Figure 1:
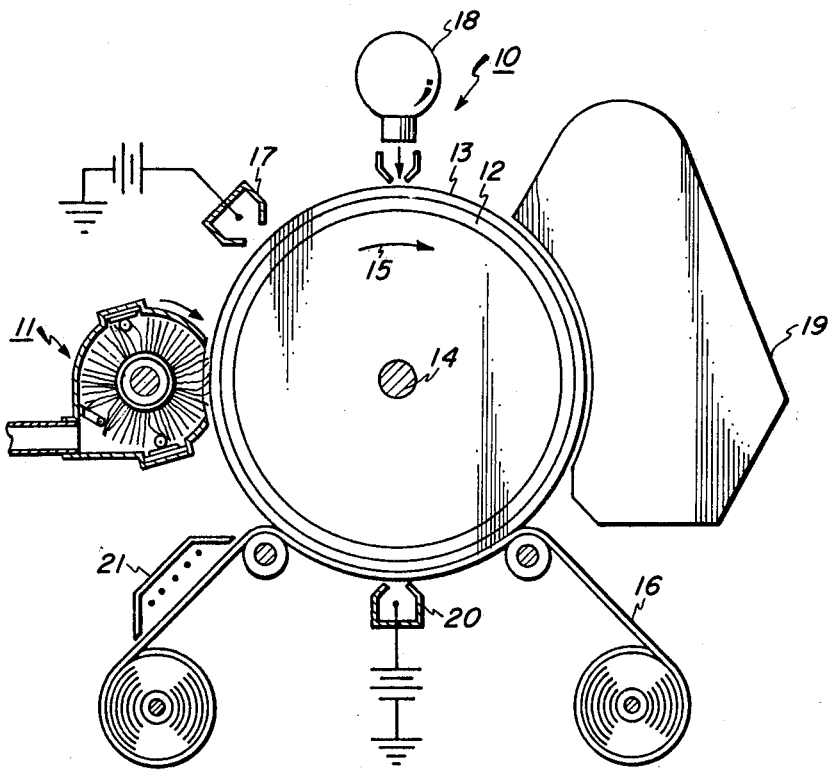
FIG. 1 is a schematic representation of an electrostatographic reproducing apparatus in accordance with this invention.

Referring now to FIG. 1 there is shown by way of example an automatic xerographic reproducing machine 10 which incorporates the cleaning apparatus 11 of the present invention. The reproducing machine 10 depicted in FIG. 1 illustrates the various components utilized therein for producing copies from an original document. Although the cleaning apparatus 11 of the present invention is particularly well adapted for use in an automatic xerographic reproducing machine 10, it should become evident from the following description that it is equally well suited for use in a wide variety of electrostatographic systems and it is not necessarily limited in its application to the particular embodiment or embodiments shown herein.

Figure 2:
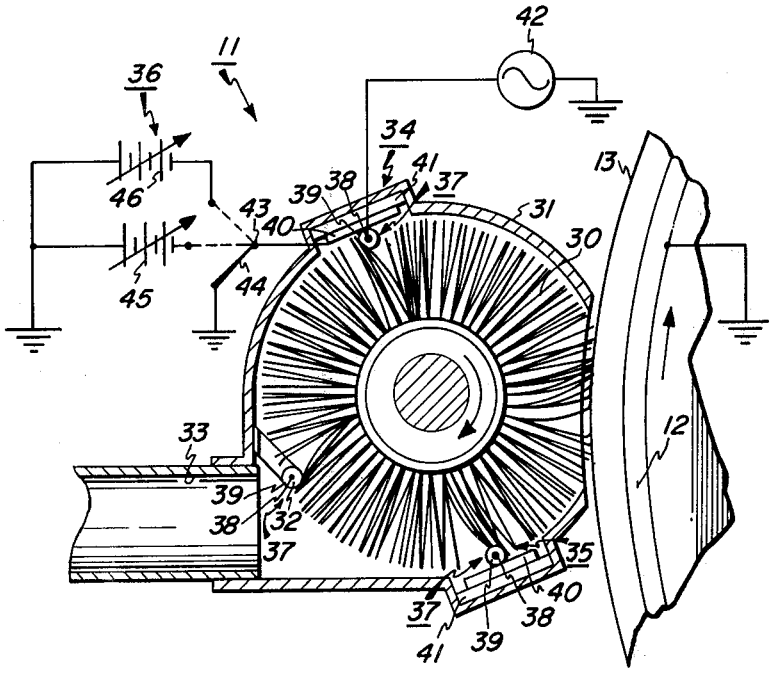
FIG. 2 is a partial cross-sectional view of the apparatus of FIG. 1 showing in greater detail an embodiment of a cleaning apparatus in accordance with the present invention.

The reproducing machine 10 illustrated in FIG. 2 employs an image recording drum-like member 12, the outer periphery of which is coated with a suitable photoconductive or photosensitive material 13. Alternatively, plate or web or belt-type recording members could be employed. One type of suitable photoconductive material is disclosed in U.S. Pat. No. 2,970,906, issued to Bixby. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproducing of the original input scene information is recorded upon a web or sheet of final support material 16 such as paper or the like.

The practice of xerography is well known in the art and is the subject of numerous patents and texts including *Electrophotography* by Schaffert, and *Xerography and Related Processes* by Dessauer and Clark, both published in 1965 by the Focal Press.

Initially, the drum 12 moves the photoconductive surface 13 through a charging station 17. At the charging station, an electrostatic charge is placed uniformly over the photoconductive surface 13 preparatory to imaging. The charging may be provided by a corona generating device of the type described in U.S. Pat. No. 2,836,725, issued to Vyverberg.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,062,110, issued to Shepardson et al.. After exposure, drum 12 rotates the electrostatic latent image recorded on the photoconductive surface 13 to development station 19 wherein a conventional developer mix including toner particles is cascaded over the photoconductive surface 13 rendering the latent image visible as a toner defined image. A suitable development system is described in U.S. Pat. No. 3,707,947 to Reichart.

The developed image on the photoconductive surface 13 is then brought into contact with web 16 of final support material within a transfer station 20 and the toner image is transferred from the photoconductive surface 13 to the contacting side of the web 16. The final support material may be paper, plastic, etc., as desired.

After the toner image has been transferred to the final support material 16, the web with the image thereon is advanced to a suitable fuser 21 which coalesces the transferred powder image thereto. One type of suitable fuser is described in U.S. Pat. No. 2,701,765, issued to Codichini, et al.. After the fusing process the web 16 is advanced to a suitable output device.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed therefrom as the drum moves through the cleaning station 11. The toner particles are cleaned from the photoconductive surface 13 by the use of brush cleaning apparatus as will be set forth in greater detail hereafter.

It is believed that the foregoing description is sufficient for purposes of the present application to illustrate the general operation of an automatic xerographic copier 10 which can embody the cleaning apparatus 11 in accordance with the present invention.

The cleaning station 11 is positioned downstream from the transfer station 20 and upstream of the charging station 17. If desired, the removed toner can be returned for reuse to the developer station 19 by a suitable system, as for example, that described in U.S. Pat. No. 3,793,986, to Latone.

It is highly desirable to selectively charge or neutralize a cleaning element 30 in an electrostatographic reproducing machine 10 to enhance its cleaning efficiency. This is exemplified by the above-noted patents to Fisher, Hudson, and Stoever. Efficiency enhancement can be accomplished by selectively charging the cleaning element 30 so that toner particles are more readily attracted to it from the imaging surface 13. Alternatively, the electrostatic attraction between the cleaning element 30 and the toner particles can be neutralized to make it easier to remove the particles from the cleaning element. It is also known to use various combinations of these treatments.

Referring now to FIG. 2, an exemplary cleaning apparatus 11 in accordance with this invention is shown in greater detail. A brush cleaning element 30 is shown, however, a foam or fabric roll or other type roller device, or a web, etc., could easily be substituted in place of the brush 30. This invention is intended to encompass not only brush cleaning, but also other known mechanical cleaning techniques.

The brush 30 in FIG. 2 is arranged to rotate counter to the direction of movement of the imaging surface within a housing 31. The housing 31 is connected to a suitable source of low pressure or vacuum (not shown) in a conventional manner in order to provide an air flow through the housing for removing the toner particles from the brush 30 and for transporting them to a suitable storage device (not shown).

A flicker bar 32 is provided adjacent the vacuum port 33 in the housing 31 in order to enhance the removal of toner particles from the brush fibers. In accordance with a particularly preferred embodiment of this invention the flicker bar 32 comprises a corona generating device as will be described in greater detail hereafter. However, if desired, it could be of a conventional nature, for example, a stainless steel bar as is known in the art.

Supported in the wall of the housing 31 are two corona generators 34 and 35 of the type described in the above-noted Sarid, et al. application. The circuit 36 for operating corona generator 34 is shown in detail. The other corona generator 35 is connected to a similar circuit which is not shown for the sake of simplicity.

While two corona generators 34 and 35 are shown, any desired number could be employed. For example, the brush cleaning system 11 of this invention could utilize soley either the post nip corona generator 34 or the pre-nip corona generator 35 or both, as desired. The purpose of the pre-nip corona generator 34 is to selectively charge the brush fibers 30 to enhance the electrostatic attraction between the brush fibers and the toner particles on the imaging surface 13. The purpose of the post-nip corona generator is to neutralize the respective charges on the brush fibers 30 and the toner particles in order to enhance the removal of the toner particles from the brush. These functions are described in greater detail by reference to the prior art noted above.

In accordance with the present invention the cleaning element 30 is arranged to not only sweep across the imaging surface 13 to wipe toner particles therefrom, but also to sweep across a corona generator 32, 34, or 35 to wipe toner particles or other contaminants therefrom. It is preferred to utilize the unique corona generating devices of the Davis, et al., or Sarid, et al. applications. The latter application approach is particularly desirable because the discharge electrode is supported throughout its length and is, therefore, more amenable to being mechanically wiped by the cleaning element 30.

The corona generators 34 and 35 includes a coronode or corona discharge electrode 37 in the form of a conductive wire 38 having a relatively thick dielectric coating 39. The wire 38 and coating 39 are shown as having a circular cross-section, but other cross-sections such as square or rectangular may be used satisfactorily. The coronode 37 is supported in contact with a conductive biasing member or shield 40. The member 40 is attached to, deposited on, or carried by a dielectric support block 41. The member 40 may take the form of a thin sheet of metal or a metal plate attached to the block 41. The member 40 includes an exposed flat surface facing and in contact with the coronode 37.

The biasing member 40 may take the form of a flat conductive plate which itself supports the electrode 37, but is insulated from the corona wire 38 by the dielectric coating 39.

The electrical energization scheme of the corona device is similar to that described in the aforenoted applications of Sarid, et al., and Davis, et al., which applications are hereby incorporated into this application by reference. An A.C. voltage source 42 is connected between the substrate drum 12 and the corona wire 38. The value of the A.C. potential is sufficient to generate a corona discharge adjacent the electrode 38.

The biasing member or shield 40 operates to control the magnitude and polarity of charge delivered to the surface 13. To that end the member 40 has coupled thereto a switch 43 which, depending on its position, permits the corona device 34 to be operated in either a charge neutralizing mode or a charge deposition mode. With the switch 43 in the position shown, the member 40 of the corona device 34 is coupled to ground via a lead 44. In this position, no D.C. field is generated between the biasing member 40 and the surface 13. With the switch 43 in the lower dotted line position, source 45 is connected and a negative charge is driven to the photoconductive surface 13 with the magnitude of the charge deposited depending on the value of the applied potential. The top dotted line position of switch 43 couples source 46 to the member 40, so the corona device operates to deposit a positive charge on the surface 13 the magnitude of which charge is dependent on the magnitude of the D.C. bias applied to the biasing member.

The wire 38 may be of any conventional conductive filiment material such as tungsten, or the like. The diameter of the wire 38 is not critical.

Any suitable dielectric material may be employed as the coating 13 which will not break down under the applied corona A.C. voltage, and which will withstand chemical attack under the conditions present in the corona device. Inorganic dielectrics such as glass have been found to perform very satisfactorily. The thickness of the dielectric coating 39 is such that substantially no conduction current or D.C. charging current is permitted therethrough.

The operation of the devices 34 and 35, as well as further details of them are amply described in the aforenoted Davis, et al. and Sarid et al. applications. It is apparent that such devices can be utilized to deposit positive or negative ions or a combination of them in order to provide charge neutralization or selective charging as desired.

The brush 30 or other desired cleaning element is arranged for movement in frictionally nipped engagement with the imaging surface 13. As shown the brush fibers also frictionally engage the discharge electrodes 37 of the respective corona generators 34 and 35. Since these electrodes include coatings of glass or other insulating material, they will not be subject to severe abrasion by the brush. The brush interference with the post-nip corona generator 35 also imparts a degree of flicking action to the brush fibers to enhance toner removal therefrom. If desired, the brush fiber interference with the electrode 37 can be made sufficiently great so that the brush fibers also engage the shield biasing or member 40 to wipe it clean as well. However, in accordance with this invention it is only necessary that the brush engage the electrode 37.

Therefore, in summary in accordance with one embodiment of this invention a cleaning apparatus 11 is provided wherein a cleaning element 30 is arranged for relative movement with respect to an imaging surface 13 and in frictional engagement therewith. The cleaning element 30 is supported in a housing 31 and at least one corona generating device 34 or 35 is also supported within the housing to cause a flow of ions onto the cleaning element to selectively charge or neutralize the element and any toner particles thereon as may be desired. The cleaning element 30 is also arranged so that it will sweepingly engage the corona generating device 34 or 35 in order to remove contaminants and toner particles that would otherwise build-up thereon. In a particularly preferred embodiment the corona generator 34 or 35 comprises a device of the type described in the aforenoted Davis, et al., or Sarid, et al. applications wherein the coronode wire 38 is coated with a thick dielectric coating 39, and most preferably supported by a shield member 40.

Preferably the interference between the brush filters and the discharge electrode 37 is at least about 0.003 inches. The brush materials, speed, etc., can be selected as desired in accordance with prior art practice.

In accordance with another embodiment of this invention the flicker bar 32 which engages the brush fibers 30 to cause them to be flexed and deflected for removing the toner particles therefrom can also comprise a corona generating device of the type described in the aforenoted Davis, et al., or Sarid et al. applications. If an unsupported electrode 37 is used, as shown, it would be desirable to have a very thick insulative coating in order to provide sufficient structural rigidity so that the electrode will not break during operation.

Using an A.C. corona or other neutralizing corona generated by the device 32 the removal of the toner particles from the brush should be enhanced by neutralizing the particles at the same time they are being mechanically flicked from the brush. Alternatively using a supported type corona generating device 34 or 35 as in the Sarid, et al. application would enhance operation as a flicker member by providing improved mechanical rigidity. The flicker bar by its action upon the brush would, of course, also be self-cleaning in the same manner as the corona generators 34 and 35.

The interference between the corona generating flicker bar 32 and the brush 30 should be in accordance with conventional practice in the brush cleaning art. Preferably the flicker bar 32 is located near the vacuum port 33. In the preferred apparatus 11 of FIG. 2, the combined flicking actions of the post-nip corona generator and the corona generating flicker bar should provide improved cleaning efficiency.

Preferably the brush fibers should be non-conductive or highly resistive. While only one discharge electrode is shown for each corona generator, if desired, plural discharge electrodes could be used for each respective corona generator.

It should be apparent that when an unsupported corona discharge electrode is utilized then the nearest metal surface such as the grounded cleaner housing would operate as the control member.

The patents and texts referred to specifically in detailed description of this application are intended to be incorporated by reference into the description.

It is apparent that there has been provided in accordance with this invention a combined corona generator and imaging surface cleaner which fully satisfies the objects, means and advantages set forth hereinbefore. While the invention has been described in conjunction with specific embodiments therefor, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In an electrostatographic reproducing machine including an imaging surface and cleaning means for removing residual material from said imaging surface, said cleaning means including at least one cleaning element which is arranged for moving engagement with said imaging surface, and further including corona generating means for applying a charging or a neutralizing corona emission to said cleaning element, said corona generating means including at least one corona discharge electrode, the improvement wherein said cleaning element is arranged for movement to frictionally engage said imaging surface and said corona discharge electrode whereby said cleaning element is adapted to clean both said imaging surface and said corona discharge electrode, wherein said cleaning means includes a first of said corona generating means for selectively applying a neutralizing corona to said cleaning element and a second of said corona generating means for applying a charging corona to said cleaning element to bias said cleaning element, and wherein each of said corona generating means include at least one corona discharge electrode and wherein said cleaning element is arranged to engage each of said corona discharge electrodes.

2. An apparatus as in claim 1, wherein each of said corona discharge electrodes comprises a wire having a thick dielectric coating thereon of sufficient thickness to prevent the flow of conduction current from the wire.

3. An apparatus as in claim 2, wherein a conductive biasing member is provided for supporting each of said discharge electrodes.

4. An apparatus as in claim 3, wherein said cleaning element comprises a brush and wherein said discharge electrode of said first corona generator also acts to flick the fibers of said brush.

5. An apparatus as in claim 4, further including a third corona generator comprising a means for flicking the fibers of said brush to remove residual material therefrom.

* * * * *